US010343299B2

(12) United States Patent
Vänttilä et al.

(10) Patent No.: US 10,343,299 B2
(45) Date of Patent: Jul. 9, 2019

(54) CHOPPING AID

(71) Applicant: Fiskars Finland Oy Ab, Helsinki (FI)

(72) Inventors: Olli-Pekka Vänttilä, Helsinki (FI); Sami Lyytikäinen, Helsinki (FI)

(73) Assignee: Fiskars Finland Oy Ab, Helsinki (FI)

( * ) Notice: Subject to any disclaimer, the term of this patent is extended or adjusted under 35 U.S.C. 154(b) by 7 days.

(21) Appl. No.: 15/307,694

(22) PCT Filed: Apr. 29, 2015

(86) PCT No.: PCT/FI2015/050294
§ 371 (c)(1),
(2) Date: Oct. 28, 2016

(87) PCT Pub. No.: WO2015/170004
PCT Pub. Date: Nov. 12, 2015

(65) Prior Publication Data

US 2017/0050335 A1 Feb. 23, 2017

(30) Foreign Application Priority Data

May 9, 2014 (EP) ..... 14167704

(51) Int. Cl.
*B27L 7/08* (2006.01)

(52) U.S. Cl.
CPC ..... *B27L 7/08* (2013.01)

(58) Field of Classification Search
CPC .... B27L 7/08; B27L 7/00; B27L 7/005; B27L 7/06; B29C 45/1676; B25B 1/00; A47J 47/005
USPC ..... 144/195.9; 83/870, 874; 269/289 R, 269/302.1
See application file for complete search history.

(56) References Cited

U.S. PATENT DOCUMENTS

| | | | | |
|---|---|---|---|---|
| 148,078 | A | 3/1874 | Mayell | |
| 177,517 | A * | 5/1876 | Hubbs | B27L 7/08 144/193.1 |
| 182,659 | A | 9/1876 | Green et al. | |
| 1,026,721 | A | 5/1912 | Thomas | |
| 1,149,525 | A | 8/1915 | Kennedy | |

(Continued)

FOREIGN PATENT DOCUMENTS

| | | |
|---|---|---|
| CZ | 6499 | 9/1997 |
| DE | 32 02 062 | 8/1983 |

(Continued)

OTHER PUBLICATIONS

First Office Action and English translation for CN Application No. 201310710949.6, dated Jul. 11, 2016, 16 pages.

(Continued)

*Primary Examiner* — Jessica Cahill
*Assistant Examiner* — Smith Oberto Bapthelus
(74) *Attorney, Agent, or Firm* — Foley & Lardner LLP

(57) ABSTRACT

A chopping aid for use in chopping of wood includes an upper section in an upper part of the chopping aid which at least partly surrounds and supports in an upright position wood arranged in the chopping aid during chopping. A base section in a lower part of the chopping aid extends at least partially along the upper section, and the upper section is supported on top of the base section by springs, which provide a dampening characteristics against impacts on the upper section of the chopping aid.

7 Claims, 2 Drawing Sheets

(56) References Cited

U.S. PATENT DOCUMENTS

| | | | | |
|---|---|---|---|---|
| 1,414,575 | A * | 5/1922 | McCart | B65B 67/12 248/101 |
| 1,823,608 | A | 9/1931 | Kalkanis | |
| 2,678,764 | A | 5/1954 | Carlson | |
| 2,751,951 | A | 6/1956 | Strathaus | |
| 3,169,760 | A | 2/1965 | Field | |
| 3,561,637 | A | 2/1971 | McConnell | |
| 3,713,463 | A | 1/1973 | Bywater, Jr. | |
| 3,818,956 | A | 6/1974 | Chamberlain | |
| 4,239,198 | A * | 12/1980 | Trupp | B25B 5/147 144/195.6 |
| 4,326,703 | A | 4/1982 | Marley | |
| 4,468,018 | A | 8/1984 | Vaizey | |
| 4,515,195 | A * | 5/1985 | Gladstein | B27L 7/00 144/195.6 |
| 4,535,980 | A * | 8/1985 | Jordan | B27L 7/00 144/195.6 |
| 4,998,643 | A | 3/1991 | Pradel | |
| 5,397,085 | A * | 3/1995 | Spagnolo | B65B 67/12 248/101 |
| 6,244,313 | B1 | 6/2001 | Sarvela | |
| 6,568,430 | B1 | 5/2003 | Shafer | |
| 7,731,074 | B2 | 6/2010 | Martin et al. | |
| 9,333,671 | B2 | 5/2016 | Huhtala et al. | |
| 9,366,368 | B2 | 6/2016 | Hausl | |
| 9,643,333 | B2 * | 5/2017 | Paden | B27L 7/00 |
| 2006/0087524 | A1 | 4/2006 | Miller | |
| 2006/0097524 | A1 | 5/2006 | Stolzman | |
| 2007/0029215 | A1 | 2/2007 | Martinez et al. | |
| 2008/0073361 | A1 * | 3/2008 | Brouard | B27L 7/08 220/669 |
| 2009/0139094 | A1 * | 6/2009 | Beloin | A23N 5/03 30/120.1 |
| 2012/0205376 | A1 | 8/2012 | Yang et al. | |
| 2014/0175723 | A1 | 6/2014 | Sandelin et al. | |

FOREIGN PATENT DOCUMENTS

| | | |
|---|---|---|
| DE | 19703829 | 8/1998 |
| DE | 20117428 | 1/2002 |
| DE | 20 2004 011 826 | 12/2004 |
| DE | 20 2004 017 096 U1 | 3/2005 |
| DE | 20 2005 001 959 | 5/2005 |
| DE | 10 2004 063 195 | 7/2006 |
| DE | 20 2006 012 458 | 10/2006 |
| DE | 20 2008 008 617 U1 | 9/2008 |
| DE | 20 2009 004 211 | 9/2009 |
| EP | 1 886 779 | 2/2008 |
| EP | 2 740 011 A1 | 6/2014 |
| FI | 3113 U1 | 10/1997 |

OTHER PUBLICATIONS

National Board of Patents and Registration of Finland Search Report for Finland Application No. 20126350, dated Sep. 18, 2013, 1 page.

National Board of Patents and Registration of Finland Search Report for Finland Application No. 20126351, dated Sep. 23, 2013, 1 page.

Office Action, U.S. Appl. No. 14/133,051, 8 pages (dated Mar. 11, 2016).

U.S. Office Action dated Aug. 28, 2015.

U.S. Office Action dated Jun. 19, 2015.

U.S. Office Action on U.S. Appl. No. 14/133,051 dated Sep. 23, 2016.

International Search Report and Written Opinion, PCT/FI2015/050294, Fiskars Garden Oy Ab, 9 pages (dated Jun. 18, 2015).

Extended European Search Report, App. No. 14167704.7, Fiskars Garden Oy Ab, 6 pages (dated Oct. 21, 2014).

English-language machine translation of DE 20 2008 008617-U1, Mijovic (Sep. 11, 2008).

English-language machine translation of DE 20 2004 017096-U1, Metzler (Mar. 24, 2005).

English-language machine translation of DE 20 2005 001959-U1, Schlappkohl (May 12, 2005).

English-language machine translation of DE 10 2004 063195-A1, Schlappkohl (Jul. 20, 2006).

English-language machine translation of 1 886 779-A1, Firepoint GMBH & Co. (Feb. 13, 2008).

* cited by examiner

CHOPPING AID

CROSS-REFERENCE TO RELATED APPLICATIONS

This application claims the benefit of priority as a National Stage Application of International Application No. PCT/FI2015/050294, filed Apr. 29, 2015, which claims priority to European Patent Application No. 14167704.7, filed May 9, 2014, which are all incorporated herein by reference in their entireties.

BACKGROUND OF THE INVENTION

Field of the Invention

The invention relates to a chopping aid for use in chopping of wood to prevent pieces of wood to spread into the surroundings outside the chopping aid during chopping.

Description of Prior Art

Previously there is known a chopping aid with a basket-like closed ring frame designed to be mounted onto a chopping block in order to prevent chopped wood to fall to the ground during chopping.

In order to work efficiently, the chopping aid should be able to dampen mishits with the axe, and additionally, during such mishits the chopping aid may not damage the cutting edge of the axe. Finally, the chopping aid should be sufficiently durable so that it does not break during use even though the number of mishits with the axe may be significant.

In practice it has been difficult to come up with suitable materials which are cheap enough for use in such a chopping aid without unduly increasing the material costs or manufacturing costs of the chopping aid.

SUMMARY OF THE INVENTION

An object of the present invention is to solve the above mentioned drawback with a novel chopping aid. This and other objects are achieved with a chopping aid according to independent claim 1.

The use of a chopping aid having a base section and an upper section supported by a plurality of springs, makes it possible to more freely utilize efficient and cost effective materials in the copping aid, which reduces the material costs and the manufacturing costs of the chopping aid.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
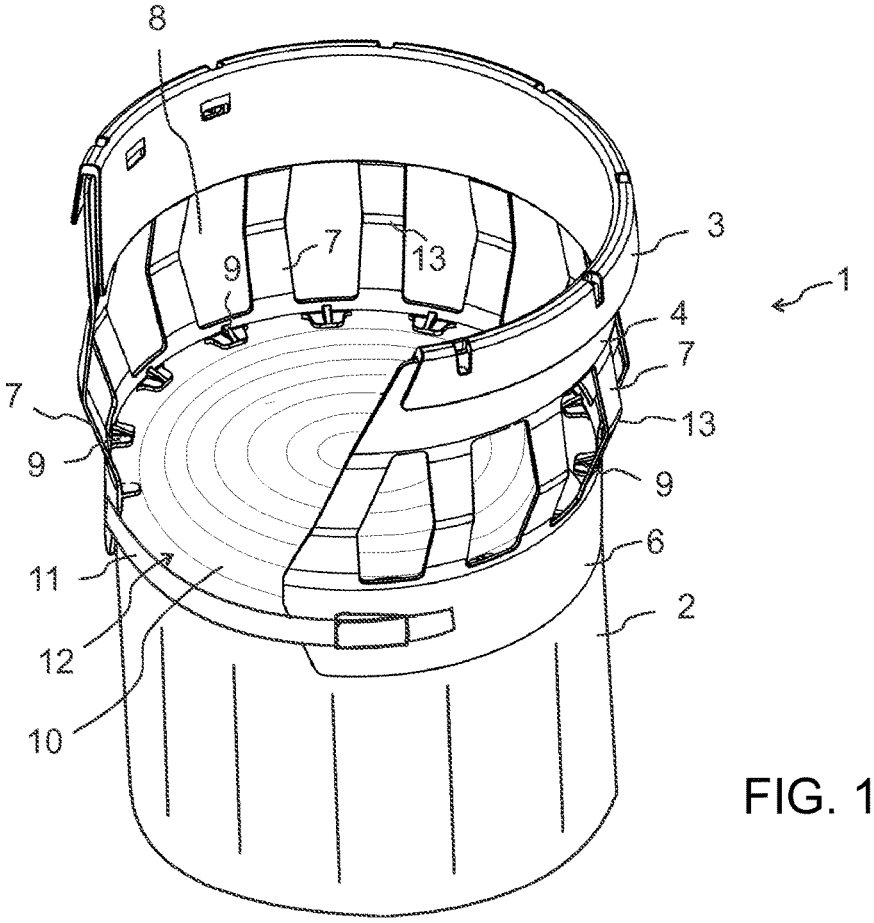
FIGS. 1 and 2 illustrate a first embodiment of a chopping aid.
Figure 2:
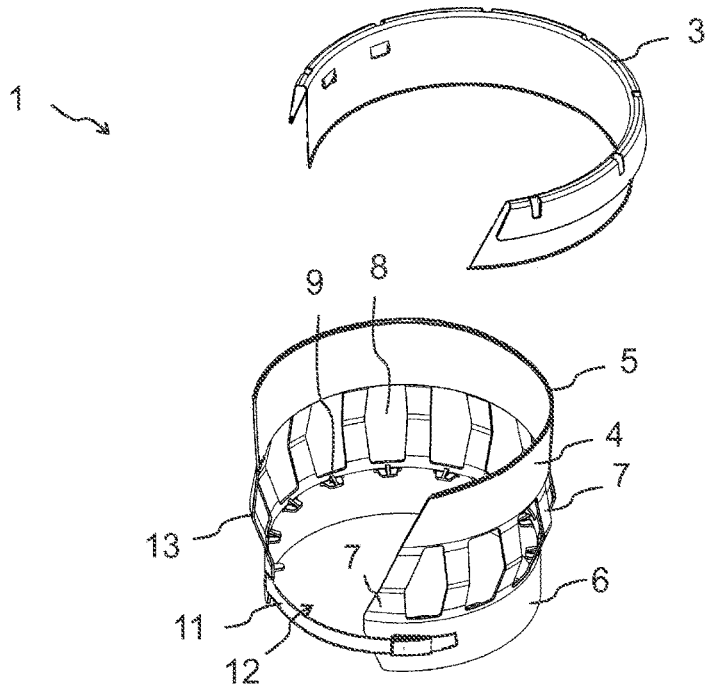

FIGS. 1 and 2 illustrate a first embodiment of a chopping aid 1. In FIG. 1 the chopping aid 1 is shown mounted on top of a support 2, which may consist of a short log used as the support on top of which chopping of wood is carried out with an axe. In FIG. 2 the collar 3 of the chopping aid 1 is illustrated separately from the other parts of the chopping aid.

The chopping aid comprises an upper section 4 in and upper part of the chopping aid 1, which at least partly surrounds and supports in an upright position wood arranged in the chopping 1 aid during chopping. In the illustrated example, though not necessarily in all embodiments, the upper section 4 has a generally cylindrical shape and consequently, a generally circular upper edge 5.

The chopping aid comprises also a base section 6 which in a lower part of the chopping aid 1 extends at least partially along the upper section 4, at a distance from the upper section 4. Consequently, the base section 6 and upper section 4 are spaced apart from each other. In the illustrated example, though not necessarily in all embodiments, the base section 4 has a generally cylindrical shape.

The upper section 4 is supported on top of the base section 6 by a plurality of springs 7 extending generally in an upward direction with spaces 8 between them. The springs 7 provide a dampening characteristic against impacts on the upper section 4 of the chopping aid. Due to the dampening provided by the springs 7 damages to the cutting edge of the axe and to the chopping aid can be minimized as the springs 7 yield in a situation when an axe hits the upper part of the chopping aid 1.

In order to make it more easy for a user to fill and empty the chopping aid with wood during chopping, the chopping aid 1 is provided with an opening 12 on a front side of the chopping aid. Therefore, in the illustrated embodiment, the upper section 4 and the base section 6 do not surround the woods in the chopping aid 1 from all sides, as the opening 12 cuts the upper section 4 and base section 6 apart on the front side. In other embodiments, however, the upper section and possibly also the base section may be circular and generally cylindrical elements, which completely surround woods in the chopping aid without any opening.

The base section 6 comprises protrusions 9 extending inwardly from the base section 6. As illustrated in FIG. 1, these protrusions 9 come into contact with an upper surface 10 of the support 2 partly protruding into the chopping aid 1. Due to these protrusions the support 2, which may consist of a short log, carries the weight of the chopping aid 1 and also receives impacts from the axe which is used for chopping wood.

The chopping aid 1 comprises a fastener 11 for attaching the chopping aid 1 to the support 2. In the embodiment of FIGS. 1 and 2 the fastener 11 consists of a clamping device with a belt extending across the opening 12, and which can be tightened such that the inner surface of the base section 6 is pressed towards the outer circumferential surface of the support 2 in order to ensure that the chopping aid 1 efficiently remains attached to the support 2. It should be observed, that instead of a fastener 11 consisting of a clamping device with a belt, as illustrated by way of example, alternative fasteners may be utilized. One alternative is to utilize as fasteners a plurality of screws which extend through the protrusions 9 or the base section 6 and towards or into the material of the support 2. In that case efficient attachment of the chopping aid can be accomplished by tightening these screws which may be wood screws, for instance, in case the support is a log of wood, for instance.

In FIGS. 1 and 2 the upper section 4, the base section 6 and springs 7 are manufactured to consist of one single part only, which is made of plastic, for instance. Such a single part may be manufactured by extrusion, for instance, which makes manufacturing very easy and efficient. As can be seen in the figures, the springs 7 are not straight plastic parts but instead they consist of two elongated parts joining together at a joint 13 which attaches the straight elongated parts to each other in an angle. Due to this these springs will dampen mishifts with an axe due to 1) yielding of the material itself (as the material is compressed), and 2) bending of the joint 13 such that the angle changes which the springs oppose by a certain amount of torque. Such a controlled dampening by torque is not obtained if the springs 7 would consist of straight parts, but is, however, obtained with the illustrated springs and also with springs consisting of curved elongated parts, for instance.

The springs 7 and also the upper section 4 and base section 6 may be manufactured of a flexible elastomeric material i.e. a material which can undergo much elastic deflection under mechanical stress and still return to its original size without permanent deflection. Suitable for these parts are e.g. rubber, Thermo Plastic Elastomer (TPE), Polypropylene (PP) or Polyethylene (PE). The springs 7, the upper section 4 and lower section 6 may be manufactured of the same material or of different materials, in which case they need to be attached to each other after manufacturing.

In the example of FIGS. 1 and 2 the chopping aid 1 is provided with a separate and detachable collar 3 covering the upper edge 5 of the upper section 4. The fact that this collar is replaceable gives more freedom for the material selection, as it becomes possible to utilize a material which treats the edge of the axe very gently during mishits, but which is not very durable and may therefore brake after a while. At that stage it is sufficient to replace only this one part, in other words collar 3, of the chopping aid 1. Suitable materials include plastic and rubber for instance. It is also possible to select for the collar 3 a material which is harder than the material of the upper section 4, such that the upper section 4 and other parts of the chopping aid 1 are efficiently protected against mishits with an axe. Materials suitable for the collar 3 include polyamide (nailon) Glassfiber reinforced Polyamide (PA) and Glassfiber reinforced Polybutylene terephthalate (PBT), for instance. A hard material efficiently distributes the force of a mishit to a large area.

Figure 3:
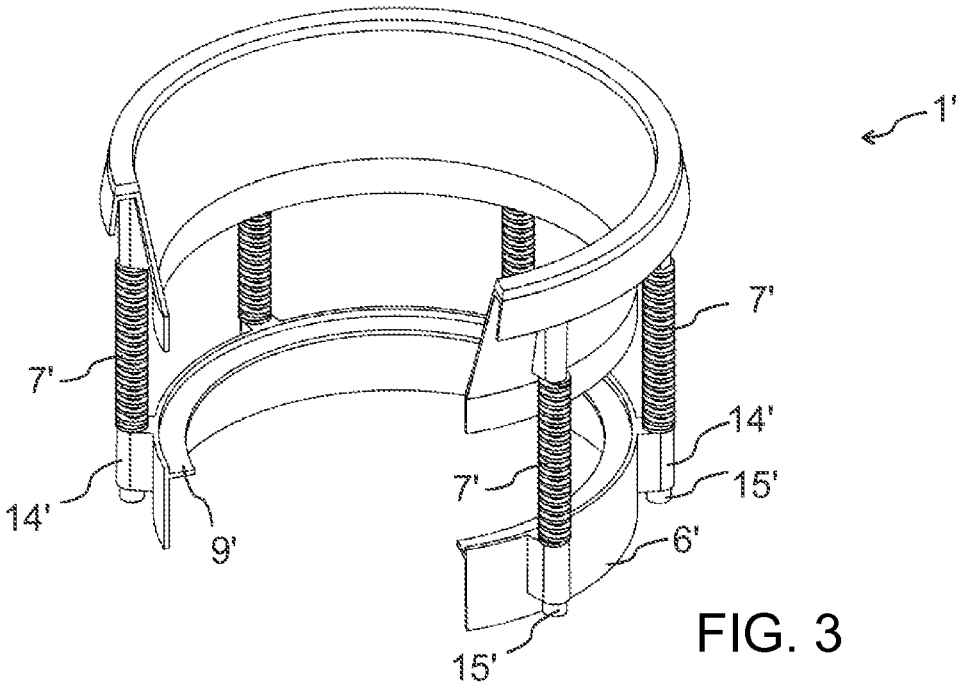
FIGS. 3 and 4 illustrate a second embodiment of a chopping aid.
Figure 4:
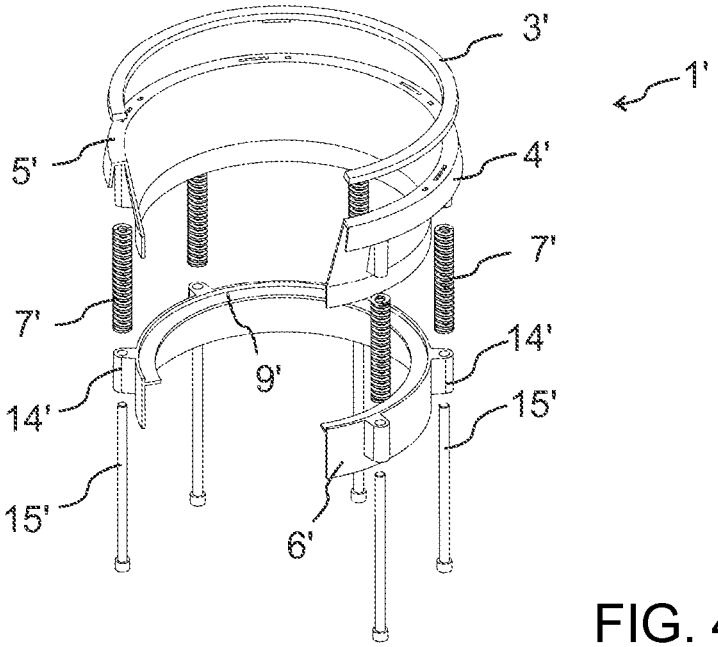

FIGS. 3 and 4 illustrate a second embodiment of a chopping aid 1'. FIG. 3 illustrates the assembled chopping aid and FIG. 4 the parts of the chopping aid before assembly.

The chopping aid of FIGS. 3 to 4 is very similar to the one explained in FIGS. 1 and 2. Therefore, the embodiment of FIGS. 3 and 4 will in the following be explained mainly by pointing out the differences between these embodiments.

Similarly, as in FIGS. 1 and 2 the the chopping aid 1' comprises an upper section 4' and a base section 6', where the base section 6' supports the upper section 4' by a plurality of springs 7'. In this embodiment the springs are metal springs, such as coil springs made of steel.

The outer surface of the base section 6' is provided with outwardly extending protrusions 14' having holes through which pins 15', which may consist of screws or bolts, have been pushed at the locations of the springs. The coil springs are assembled around these pins 15', and the upper ends of the pins 15' are attached to the upper section 4'. Once a mishit with an axe occurs, the impact is received by the upper section 4', from where the force is conducted to the springs 7'. The springs absorb the force of the impact and allow temporary the upper section 4' to move closer to the base section, while the lower ends of the pins 15' slide through the holes in the protrusions 14'. After the force of the impact has ended, the springs 7' return the upper section 4' and the pins 15' to their original position.

Similarly, as in the previous embodiment, also the chopping aid 1' of FIGS. 3 and 4 is provided with an inwardly extending protrusion 9' on an inner surface of the base section 6', which comes into contact with an upper surface of a support while the chopping aid 1' is in use. The chopping aid 1' is also provided with a fastener similarly as has been explained in connection with FIGS. 1 and 2, though not illustrated in the Figures. Similarly as in the previous embodiment, a collar 3' may be arranged to cover the upper surface 5' of the upper section 5'.

The material of the upper section 4', the base section 6' and the collar 3' may be the same as explained in connection with the embodiment of FIGS. 1 and 2. However, the springs 7' are advantageously metal springs, such a s steel springs. Such metal springs are capable of absorbing significant forces caused by impacts of an axe irrespectively of the temperature. This may be important in many cases, because it is not uncommon that wood is chopped during the winter at temperatures well below 0° C. In such conditions use of other materials may be problematic due to the fact that the elasticity of the used material may be lost during low temperatures, which may lead to cracks in the material when mishits with the axe occurs.

It is to be understood that the above description and the accompanying figures are only intended to illustrate the present invention. It will be obvious to a person skilled in the art that the invention can be varied and modified without departing from the scope of the invention.

The invention claimed is:

1. A chopping aid for use in chopping of wood, said chopping aid comprising:

an upper section which in an upper part of the chopping aid at least partly surrounds and supports in an upright position wood arranged in the chopping aid during chopping, a base section which in a lower part of the chopping aid extends at least partially along the upper section, the base section comprises one or more protrusions extending inwardly from the base section for contacting an upper surface of a support partly protruding into the chopping aid, an opening of a front side of the chopping aid extending as a cut through the upper section and base section on the front side, and a separate and replaceable collar covering an upper surface of the upper section, wherein the upper section is supported on top of the base section by a plurality of springs, which provide a dampening characteristics against impacts on the upper section of the chopping aid, and the springs together with the upper section at least partly surrounding and supporting in an upright position wood arranged in the chopping aid when the chopping aid is filled with wood during chopping.

2. The chopping aid according to claim 1, wherein the upper section, the base section and the springs are manufactured of plastic.

3. The chopping aid according to claim 2, wherein the upper section, the base section and the springs are manufactured to consist of one single part.

4. The chopping aid according to claim 1, wherein the upper section and the base section are manufactured of plastic, and the springs are metal springs.

5. The chopping aid according to claim 1, wherein the upper section and the base section are manufactured of plastic, and the springs are rubber springs.

6. The chopping aid according to claim 1, wherein the base section is provided with one or more fasteners for attaching the chopping aid to a support.

7. The chopping aid according to claim 1, wherein the upper section and the base section are generally cylindrical parts.

* * * * *